US005909064A

United States Patent [19]

Feil et al.

[11] Patent Number: 5,909,064

[45] Date of Patent: Jun. 1, 1999

[54] TIME DELAY RELAY CIRCUIT

[75] Inventors: John William Feil, Fayetteville, Ga.; Wayne Ray Weiss, Evansville, Ind.

[73] Assignee: Siemens Electromechanical Components, Inc., Princeton, Ind.

[21] Appl. No.: 08/893,241

[22] Filed: Jul. 16, 1997

[51] Int. Cl.[6] ..... H01H 7/00

[52] U.S. Cl. ..... 307/141; 307/125; 307/141.4; 361/195

[58] Field of Search ..... 307/112, 113, 307/116, 125, 138, 139, 140, 141, 141.4, 141.8

*Primary Examiner*—Jeffrey Gaffin
*Assistant Examiner*—Jonathan S. Kaplan
*Attorney, Agent, or Firm*—Donald B. Paschburg

[57] ABSTRACT

A time delay relay circuit of the present invention includes a power supply terminal, a relay having a first terminal connected to the power supply terminal, and a timing circuit, for activating the relay for a preset duration, having a supply input for receiving power for the timing circuit. Also included is a means for connecting the supply input of the timing circuit to the power supply terminal during operation of the timing circuit and activation of the relay and disconnecting the supply input of the timing circuit from the power supply terminal during non-operation of the timing circuit. The means connecting the supply input to the power supply terminal may be a switch which is closed and opened to start the preset duration time running within the timing circuit. During the preset duration, the switch remains open. The relay is closed making a connection between the power supply terminal and the supply input. In a preferred embodiment, a pair of diodes are arranged such that current is prevented from flowing toward the switch when the relay is closed and current is prevented from flowing toward the load when the relay is open. The time delay relay circuit prevents current flow through the circuit when the circuit is connected to a power supply and not in use.

18 Claims, 3 Drawing Sheets

TIME DELAY RELAY CIRCUIT

BACKGROUND OF THE INVENTION

1. Field of the Invention

This disclosure relates to a time delay relay circuit for battery powered devices and, more particularly, to a relay having minimal battery drain when not in use.

2. Description of the Related Art

Time delay relays are used in many industries. The purpose of a time delay relay is to provide a mechanism for turning a device on or off after a predetermined amount of time. One example of a practical application for the time delay relay is for use in a motor vehicle, for example a tractor. Tractors are often left idle for a few months at a time and consequently small amounts of stand-by current flow through time delay relay circuits employed by the tractor. Over long periods of idle time the battery in the tractor is drained, preventing the operator from turning the engine when the tractor is once again needed.

A typical time delay relay 8 is shown in FIG. 1. A battery supply 10 has a positive terminal 12 and a battery ground 11. The positive terminal is connected to a momentary normally opened switch 16. The switch 16 is also connected to a enable input 34 of a timing circuit 30. Positive terminal 12 is connected to a first terminal 14 of an electromagnetic relay 18. Electromagnetic relay 18 has a second terminal 15 connected to a load 38. Load 38 is also connected to ground. Between the first terminal 14 and second terminal 15 is a movable contact which opens and closes according to a field generated by a relay coil 22. The first terminal 14 is also connected to a second input 28 of timing circuit 30. The timing circuit 30 has a first output 26 and a second output 32. Outputs 26 and 32 energize and deenergize the relay coil 22 to open and close movable contact 20. Timing circuit 30 also is connected to ground. Typically relays contain a suppression resistor 24 across the relay coil 22 to alleviate potential damage caused by switching transients.

Normal operation of the time delay relay circuit includes the closing of momentary normally open switch 16. This enables timing circuit 30 through enable input 34. The timing circuit draws power from positive terminal 12 through supply input 28. The relay coil 22 is energized through outputs 26 and 32. The movable contact 20 closes making a connection between first terminal 14 and second terminal 15. The timing sequence begins holding the contact 20 in a closed position for a predetermined amount of time. Closing contact 20 supplies power across the load 38 until the timing sequence expires.

This circuit has a drawback, however. When it is not in use it allows battery 10 to drain. Although current cannot pass through switch 16 when open nor can it pass across contact 20 when open. A path does exist for current leakage, however. When the circuit is not in use, i.e. stand-by mode, current from positive terminal 12 can flow to input 28 and than to ground 36. Although this current is small due to the high impedance path through timing circuit 30, over time battery 10 will drain. This can be a great disadvantage if, for example, a vehicle with a time delay relay in it remains standing idle for an extended period of time. The battery will drain, and when it is necessary to use the vehicle it will not start. Therefore, a need exists for a time delay relay that can reduce the amount of current flowing through the circuit to essentially zero amperes when the circuit is not in use.

SUMMARY OF THE INVENTION

A time delay relay circuit of the present invention includes a power supply terminal, a relay having a first terminal connected to the power supply terminal, and a timing circuit, for activating the relay for a preset duration, having a supply input for receiving power for the timing circuit. Also included is a means for connecting the supply input of the timing circuit to the power supply terminal during operation of the timing circuit and activation of the relay and disconnecting the supply input of the timing circuit from the power supply terminal during non-operation of the timing circuit.

The means connecting the supply input to the power supply terminal is a switch which is closed and opened to start the preset duration time running within the timing circuit. During the preset duration, the switch remains open. The relay is closed making a connection between the power supply terminal and the supply input. In a preferred embodiment, a pair of diodes are arranged such that current is prevented from flowing toward the switch when the relay is closed and current is prevented from flowing toward the load when the relay is open. The time delay relay circuit prevents current flow through the circuit when the circuit is connected to a power supply and not in use.

BRIEF DESCRIPTION OF DRAWINGS

The invention will be described in detail in the following description of preferred embodiments with reference to the following figures wherein.

DETAILED DESCRIPTION OF PREFERRED EMBODIMENTS

The present disclosure describes a time delay relay for use in stored energy power supply circuits. A time delay relay includes a circuit for reducing the current flowing through the circuit to zero when the circuit is in stand-by mode. This disclosure also describes alternate embodiments of the time delay relay circuit.

Figure 1:
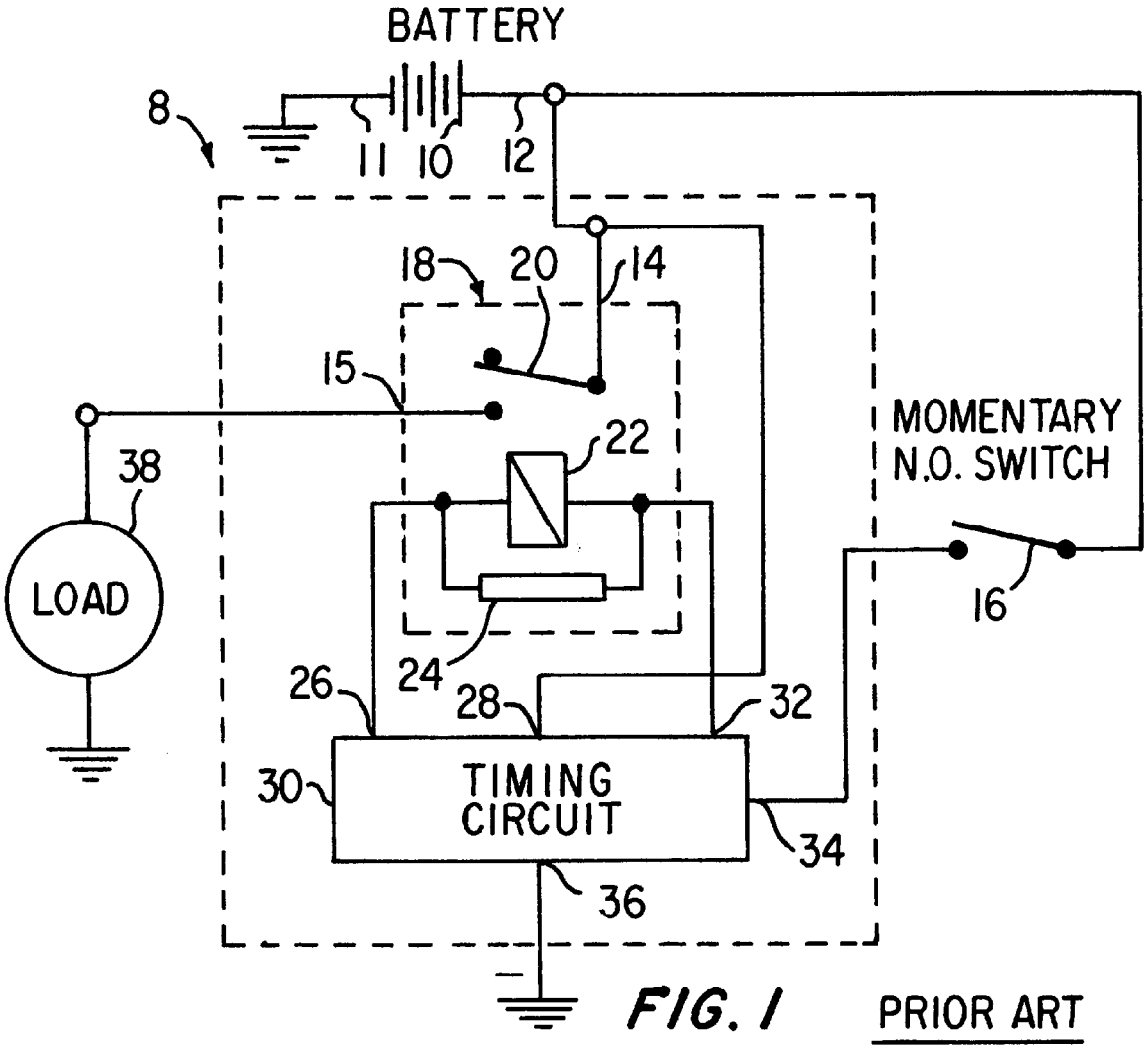
FIG. 1 PRIOR ART
FIG. 1 is a schematic diagram of a prior art time delay relay circuit.
Figure 2:
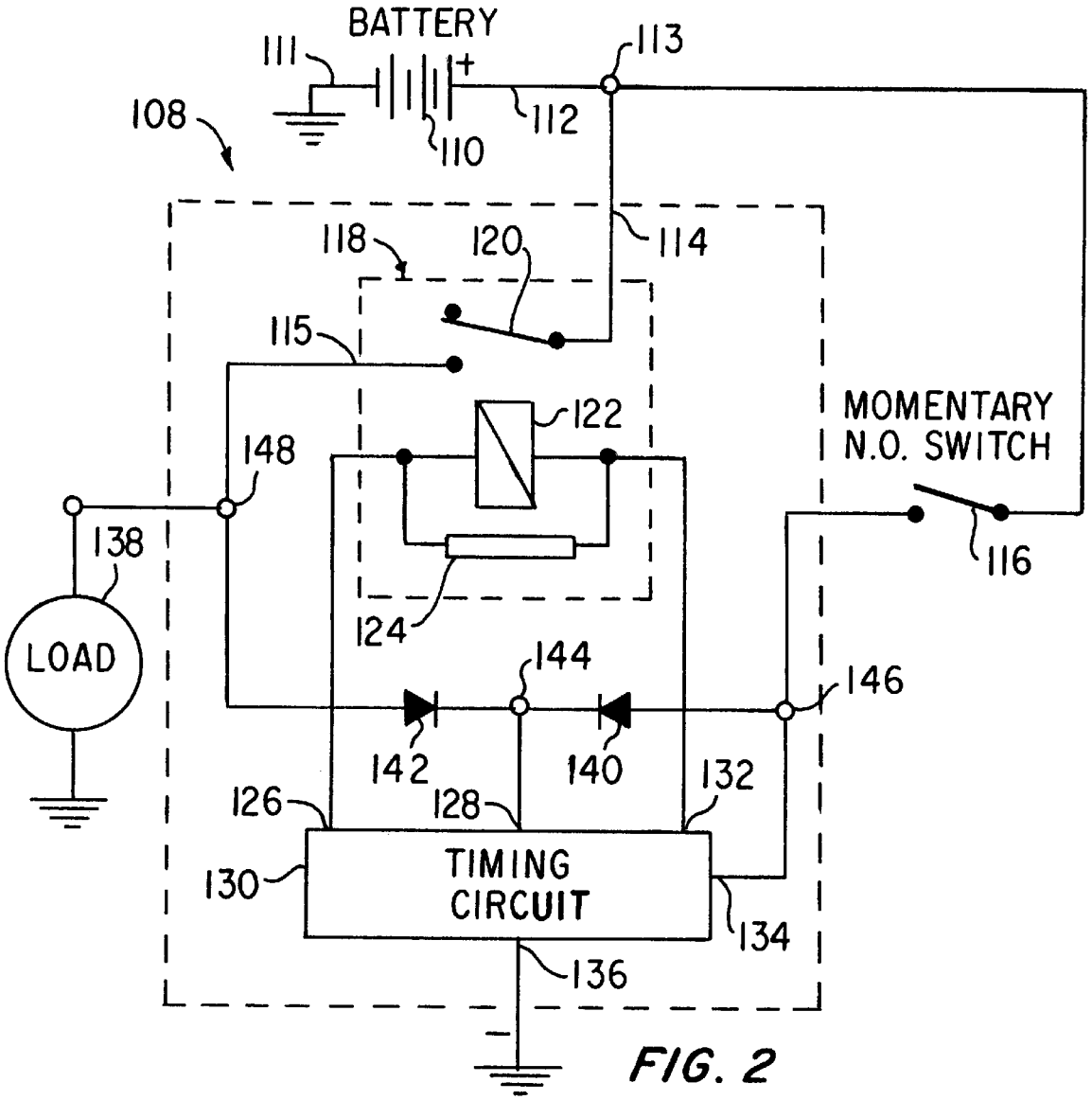
FIG. 2 is a schematic diagram of a time delay relay circuit which has diodes preventing current flow in the stand-by mode.

Referring now in specific detail to the drawings in which like reference numerals identify similar or identical elements throughout the several views, and initially to FIG. 2, one embodiment of a time delay relay circuit 108 constructed in accordance with the present disclosure is shown generally as time delay relay circuit 108. A direct current power supply 110 has a positive terminal 112 and a reference terminal 111, for example, ground. In a preferred embodiment direct current power supply 110 is a battery. The positive terminal is connected to a momentary normally opened switch 116. Switch 116 is also connected to a node 146. Positive terminal 112 is connected to a first terminal 114 of a relay 118. Relay 118 can be any type of relay device. For example, it can be an electromagnetic relay. Relay 118 has a second terminal 115 connected to a load 138. Load 138 is also connected to a reference potential. Between the first terminal 114 and second terminal 115 is a movable contact 120 which opens and closes according to a field generated by a relay coil 122. A timing circuit 130 has a first output 126 and a second output 132. Outputs 126 and 132 energize and deenergize the relay coil 122 to open and close movable contact 120. Timing circuit 130 also is connected to the reference potential. Relay 118 contains a suppression resistor 124 across the relay coil 122 to alleviate potential damage caused by switching transients.

Node 146 connects to an enable input 134 to timing circuit 130. Node 146 is also connected to a first diode 140. Diode 140 is biased such that current only flows from switch 116 to node 144. Node 144 connects to a second input of timing circuit 130 and to a second diode 142 at node 148. Diode 142 is in turn connected to the load 138 and second terminal 115 of relay 118. Diode 142 is biased to allow current flow only from node 148 to node 144.

The time delay relay circuit is activated by closing momentary normally open switch 116. This enables timing circuit 130 through enable input 134. The timing circuit draws current from positive terminal 112 through supply input 128 through diode 140 as long as switch 116 is closed. Relay coil 122 is energized through outputs 126 and 132. The movable contact 120 closes making a connection between first terminal 114 and second terminal 115. Switch 116 is then opened. The timing sequence begins holding contact 120 in a closed position for a predetermined amount of time, for example 90 seconds. Closing contact 120 supplies power across the load 138 until the timing sequence expires. The load may be another relay in a lighting circuit, for example. In addition current flows to timing circuit 130 when contact 120 is closed through contact 120 and diode 142.

Timing circuit 130 can be an integrated circuit chip or a simple resistor- capacitor circuit with a voltage sensing means as is known in the art. In a preferred embodiment a U6046B chip commercially available from Temic Semiconductors can be used.

Describing in more detail the function of diodes 140 and 142, the cycle of the time delay relay circuit begins when switch 116 is closed. Timing circuit is powered through supply input 128. Diode 140 allows current to flow to supply input 128 without allowing current flow to switch 116 or enable input 134 once relay 118 is energized. Diode 142 also is connected to timing circuit's 130 supply input 128 and supplies current thereto after relay 118 has been energized and contact 120 is closed. Diode 142 prevents current from flowing into load 138 from switch 116 at startup. When the timing sequence ends contact 120 opens and all current is shut down.

Accordingly, it is readily apparent to one ordinarily skilled in the art that the two paths connecting positive terminal 112 to supply input 128 have switch 116 and contact 120 which are open during stand-by mode. Hence, time delay relay circuit 108 prevents current drain in stand-by mode.

Figure 3:
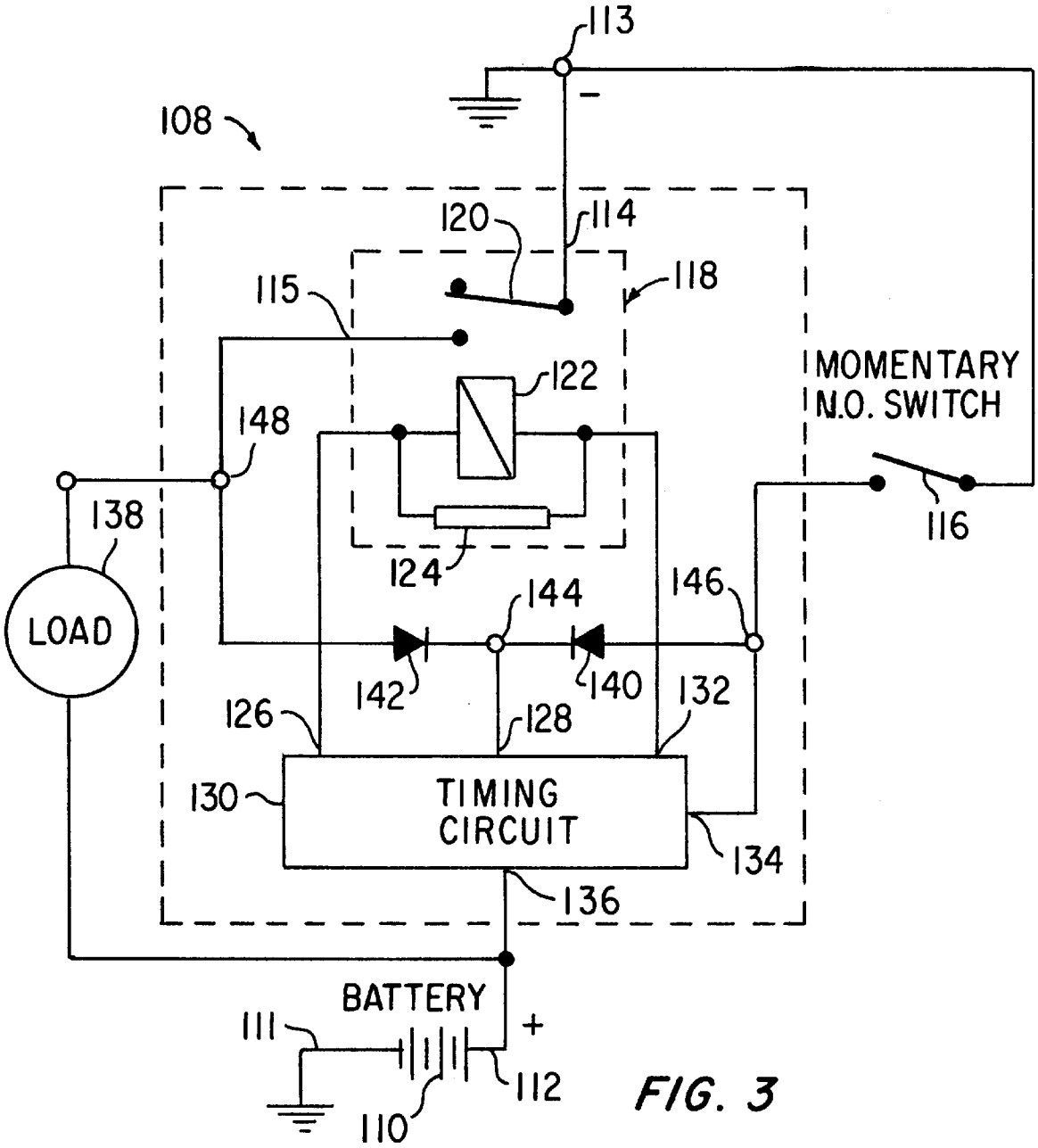
FIG. 3 is a schematic diagram of an alternate embodiment of a time delay relay circuit which has diodes preventing current flow in the stand-by mode.

Referring now to FIG. 3, an alternate embodiment of the time delay relay circuit 108 which includes reversing potentials across the circuit. Direct current power supply 110 has a reference terminal 111 and a positive terminal 112. Positive terminal 112 is now directly connected to load 138 and timing circuit port 136. Load 138 is also connected to second relay terminal 115 by node 148, as before. Node 148 is connected to diode 142, however in this embodiment the bias of diode 142 is reversed. Diode 140 is connected between nodes 144 and 146 as before. However, the bias is reversed. Further, node 113 is now connected to the reference potential. The circuit described in FIG. 3 works to disable the current path through the reference potential connection rather then disabling direct current power supply 110. In both embodiments current is prevented from draining the power supply 110.

Having described preferred embodiments of a novel time delay relay circuit (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as delined by the appended claims. Having thus described the invention with the details and particularity required by the patent laws, what is claimed and desired protected by Letters Patent is set forth in the appended claims.

What is claimed is:

1. A time delay relay circuit comprising:

a power supply terminal of a direct current source, for supplying a driving current;

a relay having a first terminal and a second terminal, the first terminal connected to the power supply terminal of said direct current source, and the second terminal for connecting a load;

a timing circuit which draws said driving current from said direct current source, for activating the relay for a preset duration, having a supply input for receiving power for the timing circuit, said timing circuit further having an enable input for enabling the timing circuit;

means for connecting the supply input of the timing circuit to the power supply terminal during operation of the timing circuit and activation of the relay and disconnecting the supply input of the timing circuit from the power supply terminal during non-operation of the timing circuit; and a pair of diodes for preventing current flow toward the enable input when the relay is closed and preventing current flow toward the load when the relay is open.

2. A time delay relay circuit as recited in claim 1 wherein the means for connecting the supply input to the power supply terminal includes a switch.

3. A time delay relay circuit as recited in claim 2 wherein the switch is a momentary normally open switch.

4. A time delay relay circuit as recited in claim 3 wherein the switch is also connected to an enable input of the timing circuit for enabling the timing circuit.

5. A time delay relay circuit as recited in claim 1 wherein the means for connecting the supply input to the power supply terminal includes the relay.

6. A time delay relay circuit as recited in claim 1 wherein the relay comprises a second terminal for connecting the power supply terminal to a load.

7. A time delay relay circuit as recited in claim 6 wherein the load is a relay in a lighting circuit.

8. A time delay relay circuit as recited in claim 1 wherein the power supply terminal is connected to a battery.

9. A time delay relay circuit as recited in claim 1 wherein the timing circuit is an integrated circuit.

10. A time delay relay circuit as recited in claim 1 wherein the relay is an electromagnetic relay.

11. A time delay relay circuit comprising:

a power supply terminal of a direct current source, for supplying a driving current;

a relay having a first terminal and a second terminal, the first terminal connected to the power supply terminal of said direct current source and the second terminal for connecting a load;

a timing circuit, which draws said driving current from said current source, for activating the relay for a preset duration, having a supply input for powering the timing circuit and an enable input for enabling the timing circuit;

a switch having a first contact connected to the power supply terminal and a second contact connected to the enable input for enabling the timing circuit;

the timing circuit supply connected to the second terminal and the second contact of the switch; and a first diode arranged such that current is prevented from flowing toward the enable input when the relay is closed;

a second diode arranged such that current is prevented from flowing toward the load when the relay is open.

12. A time delay relay as recited in claim 11 wherein the polarity of the circuit is reversed.

13. A time delay relay circuit as recited in claim 11 wherein the load is a relay in a lighting circuit.

14. A time delay relay circuit as recited in claim 13 wherein the power supply terminal is connected to a battery.

15. A time delay relay circuit as recited in claim 11 wherein the timing circuit is an integrated circuit.

16. A time delay relay circuit as recited in claim 11 wherein the relay is an electromagnetic relay.

17. A time delay relay circuit as recited in claim 11 wherein the switch is a momentary normally open switch.

18. A time delay relay circuit comprising:

a power supply terminal of a direct current source, for supplying a driving current;

an electromagnetic relay having a first terminal and a second terminal, the first terminal connected to the power supply terminal of said direct current source and the second terminal for connecting a load;

a timing circuit, which draws said driving current from said direct current source, for activating the relay for a preset duration, having a supply input and an enable input; the timing circuit further comprising two outputs for activating the relay;

a switch having a first contact connected to the power supply terminal and a second contact connected to the enable input for enabling the timing circuit;

the timing circuit supply connected to the second terminal and the second end of the switch; and a first diode arranged such that current is prevented from flowing toward the enable input when the relay is closed;

a second diode arranged such that current is prevented from flowing toward the load when the relay is open.

* * * * *